US006685547B2

(12) United States Patent
Boman

(10) Patent No.: US 6,685,547 B2
(45) Date of Patent: Feb. 3, 2004

(54) PNEUMATIC SANDING ROLL FOR FLEXIBLE ABRASIVE CLOTH SLEEVE

(76) Inventor: Peter Boman, Ornstigen 22, S-918 31 Savar (SE)

( * ) Notice: Subject to any disclaimer, the term of this patent is extended or adjusted under 35 U.S.C. 154(b) by 198 days.

(21) Appl. No.: 09/898,037

(22) Filed: Jul. 2, 2001

(65) Prior Publication Data

US 2002/0004363 A1 Jan. 10, 2002

Related U.S. Application Data

(60) Provisional application No. 60/217,062, filed on Jul. 10, 2000.

(51) Int. Cl.[7] ..... B24D 9/02

(52) U.S. Cl. ..... 451/495; 451/504; 451/505; 451/507

(58) Field of Search ..... 451/495, 504, 451/505, 344, 348, 358, 440, 526–529, 507

(56) References Cited

U.S. PATENT DOCUMENTS 704,509 A * 7/1902 Cadman ..... 451/505
3,178,863 A * 4/1965 Mikiya ..... 451/505
3,848,374 A * 11/1974 Hasegawa ..... 451/505
4,328,866 A * 5/1982 Zimmerman ..... 166/317
4,897,968 A * 2/1990 Hutt ..... 451/505
5,351,447 A * 10/1994 Grauert ..... 451/505
5,672,096 A * 9/1997 Amarosa et al. ..... 451/504

* cited by examiner

*Primary Examiner*—Joseph J. Hail, III
*Assistant Examiner*—David B. Thomas
(74) *Attorney, Agent, or Firm*—Rolf Fasth; Fasth Law Offices

(57) ABSTRACT

The pneumatic sanding roll has an elongate housing with an outside driving axle separated from an inside portion by a large diameter disc. An air supply channel extends in the housing from the driving axle to a mouth of the inside portion. A spacer is in operative engagement with the driving axle and the disc. A semi-spherical hollow flexible rubber socket has a bottom edge portion and includes an opening. The bottom edge portion is captured between the spacer and the large diameter disc so that an enclosed cavity is defined inside the rubber socket. An abrasive semi-spherical cloth sleeve encloses the rubber socket and is locked to the rubber socket when the rubber socket is filled with air and expanded. A rubber tube is sealingly arranged about the inside portion to cover the mouth of the air supply channel to prevent air in the cavity from leaking back out through the air supply channel.

7 Claims, 2 Drawing Sheets

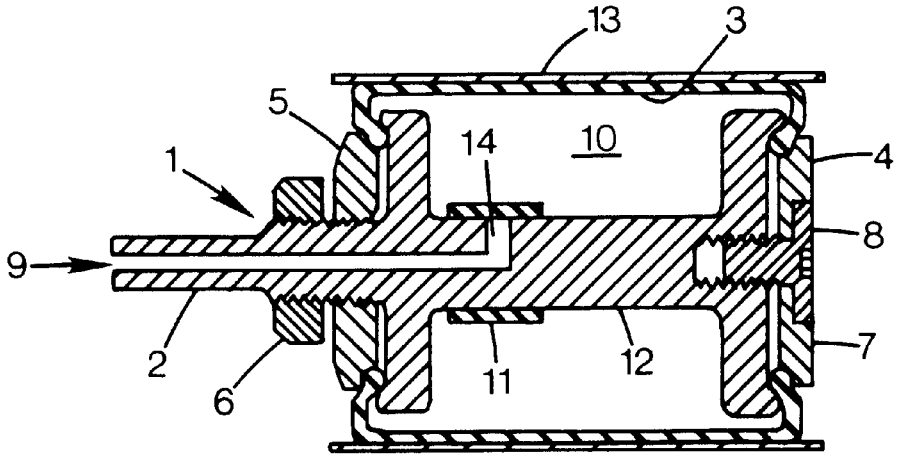
FIG. 1
FIG. 2
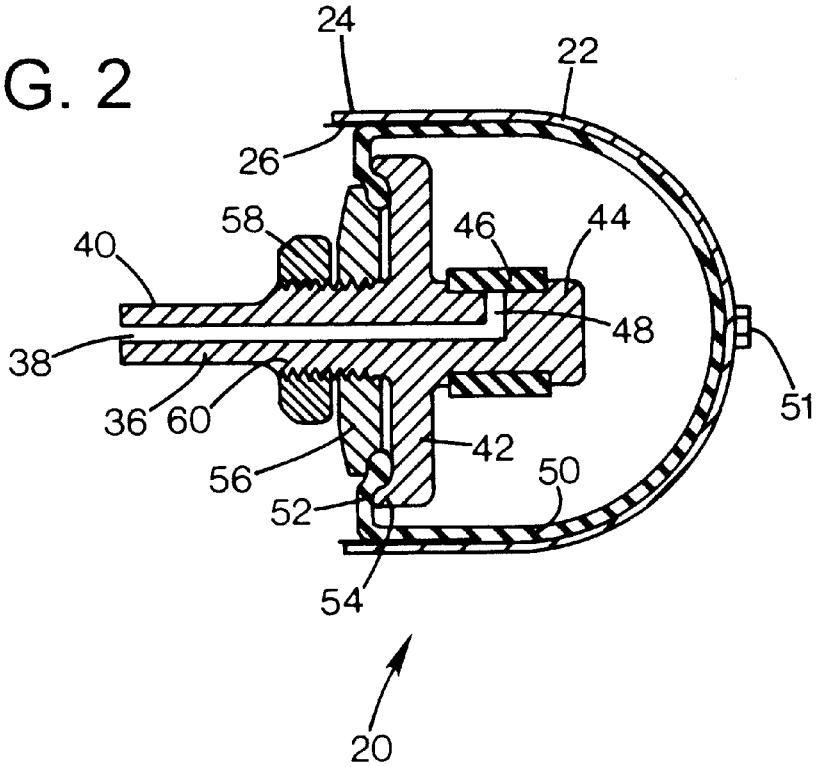

FIG. 3
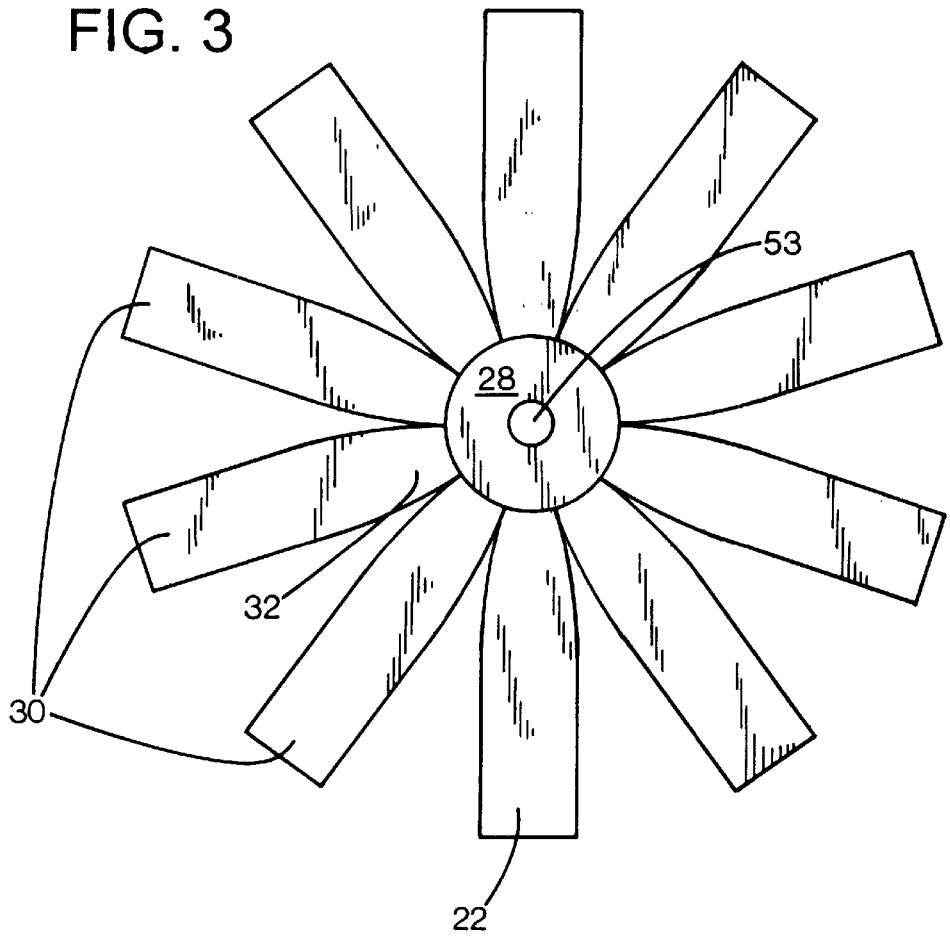
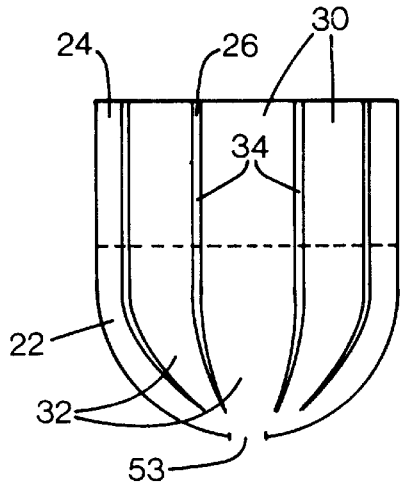
FIG. 4

PNEUMATIC SANDING ROLL FOR FLEXIBLE ABRASIVE CLOTH SLEEVE

PRIOR APPLICATION

This is a utility patent application based upon U.S. Provisional Patent Application No. 60/217,062, filed Jul. 10, 2000.

TECHNICAL FIELD

The present invention herein described relates to a sanding roll that is filled with air wherein an abrasive cloth sleeve mounted thereon is locked in place by the expanding rubber socket.

BACKGROUND AND SUMMARY OF THE INVENTION

Sanding and polishing, particularly of wood but also other materials, with sandpaper and abrasive cloth are time consuming work that is made easier by using sanding rolls in different configurations. One commonly occurring problem with many sanding rolls is that they are too hard and cause vibration, they cause grades and remove too much material instead of being soft and flexible so that an even and smooth surface is created while maintaining the desired shape. Air filled rubber sanding rolls having endless bands of abrasive cloth have provided a solution to this problem for a long time. The technical construction of these rolls has not made it possible to make them in small dimensions while maintaining the same or similar level of usefulness.

One object of the present invention is to provide sanding rolls having small dimensions while keeping or even improving the areas of application compared to conventional air sanding rolls. To solve this problem, a valve construction has been invented that has an air inlet drilled along a center line of the driving axle and which hole terminates in the inside of the sanding roll. The air is let out by loosening a nut that holds the upper spacer in place.

More particularly, the pneumatic sanding roll of the present invention has an elongate housing with an outside driving axle separated from an inside portion by a large diameter disc. An air supply channel extends in the housing from the driving axle to a mouth of the inside portion. A spacer is in operative engagement with the driving axle and the disc. A semi-spherical hollow flexible rubber socket has a bottom edge portion and includes an opening. The bottom edge portion is captured between the spacer and the large diameter disc so that an enclosed cavity is defined inside the rubber socket. An abrasive semi-spherical cloth sleeve encloses the rubber socket and is locked to the rubber socket when the rubber socket is filled with air and expanded. A rubber tube is sealingly arranged about the inside portion to cover the mouth of the air supply channel to prevent air in the cavity from leaking back out through the air supply channel.

BRIEF DESCRIPTION OF THE DRAWING

FIG. 1 is a cross-sectional side view of the pneumatic sanding roll of the present invention;

FIG. 2 is a cross-sectional side view of an alternative embodiment of the sanding device; and FIG. 3 is a top view of the unfolded abrasive cloth used in the sanding device shown in FIG. 2; and FIG. 4 is a side view of the folded abrasive cloth used in the sanding device shown in FIG. 2.

DETAILED DESCRIPTION

With reference to FIG. 1, the shaft of the sanding roll device has been marked with 1 on the drawing, and the drive axle is marked with 2 and the captured rubber socket is marked with 3. This is equipped with O-rings 4 and are tightened with a spacer 5 and a nut 6 on the upper part of the sanding roll and at the bottom of the sanding roll by a spacer 7 and a screw 8. The air supply channel is marked with 9. The driving axle may extend into a chamber 10 of the inside of the device 1. A piece of rubber tube 11 functions as a back valve and encloses the middle axle 12 of the shaft and also the end of the air supply channel that is marked with 14. The abrasive cloth is marked with 13.

With reference to FIGS. 2–4, the sanding roll 20 has a semi-spherical shaped bendable abrasive material 22. A tube-shaped open end 24 of the material 22 has a flexible adhesive tape 26 attached to an inside the material 22 so form the tube shape. Preferably, the tape 26 is bendable but not extendable. The tape 26 may be attached to the inside of the material 22 in any suitable way such as by Velcro. It may even be possible to loosely apply the tape or band 26 outside the material 22 because, as is described below, the band 26 is then pressed hard against the material 22 and the friction between the two surfaces alone may be sufficient to hold the material 22 in place.

As best shown in FIG. 3, the abrasive material 22 has a star-shaped form, when flattened, that includes a round center 28 and outwardly protruding leg sections 30. Preferably, the material 22 is bendable but not extendable. Each leg section 30 has a tapered inner end 32 that is attached to or integral with the round center 28. The abrasive material 22 forms the semi-spherical shape by attaching the leg portions 30 to the tube-shaped tape 26, as best shown in FIG. 4. There may be elongated gaps 34 formed between each leg portion 30.

The device 20 has an elongate housing 36 that has a channel 38 defined in a rod end 40. The rod end 40 may be attached to a rotating apparatus to drive or rotate the device 20. The housing 36 has a large diameter disc 42, disposed in the middle of the housing 36, and a inner member 44 that has a back valve member 46 attached thereto. The member 46 may be a rubber hose. The channel 38 extends all the way from the rod end 40 to the inner member 44 and an outlet 48 of the channel 38 may be covered by the member 46 so that air is let out through the outlet 48 but not back into the channel 38.

A semi-spherical hollow rubber body 50 may have a bottom edge 52 captured between a protrusion 54 of the disc 42 and a spacer 56 so that the body 50 is firmly held to the disc 42 and the spacer 56 when the spacer 56 is tightened against the disc 42 by a nut 58 that is threadedly engaging a threaded section 60 of the housing 36. The body 50 may have a top protrusion 51 that may fit into a central opening 53 of the material 22 (see FIG. 3) to ensure the body 50 is properly inserted into the material 22.

Preferably, the body 50 is flexible and expandable and may be folded or bent inwardly to fit between the spacer 56 and the disc 42 prior to tightening by the nut 58. Preferably, the spacer 56 is dimensioned to matchingly fit inside the protrusion 54 of the disc 42 to more effective lock the bottom edge of the body 50 between the disc 42 and the spacer 56. In this way, the inner member 44 and the disc 42 may be disposed inside the body 50.

Prior to inflating the body 50, through the channel 38, the body 50 may be inserted into the open end of the material 22 formed by the tape 26. Preferably, the diameter of the open end of the material 22 is slightly larger than the diameter of the disc 42. When the body 50 is fully inserted into the material 22 so that the outer surface of the body 50 engages the inside of the material 22, then air may be pumped into the channel 38 to fill the hollow body 50 with air and the gaps 34 allows the material 22 to conform to the expanding body 50. Since the body 50 is made of an expandable material, the body expands and presses against the inside of the material 22 until the body 50 fully engages the material 22. The diameter of the body 50 also expands against the tape 26 to firmly hold the material 22 to the body 50. The portion of the body 50 that is outside the tape 26 may expand to a diameter that is greater than the diameter of the tape 26 so that the body 50 and the material 22 may bulge beyond the tape 26 and expand into a slightly rounded body shape.

An important feature of the present invention is that the material 22 and the body 50 are relatively soft and may conform to the surface of the components that are to be polished by the abrasive surface of the material 22 while being firmly held to the housing 36.

When the material 22 is worn out, the body 50 may be collapsed by deflating the air inside the body 50 by, for example, loosening the nut 58, and then pull off the material 22 and replace the material 22 with a new semi-spherical material that may be expanded using the same procedure, as described above.

While the present invention has been described in accordance with preferred compositions and embodiments, it is to be understood that certain substitutions and alterations may be made thereto without departing from the spirit and scope of the following claims.

I claim:

1. A pneumatic sanding roll, comprising:

an elongate housing having an inside portion and a free outside driving axle separated from the inside portion by a large diameter disc, the driving axle having an air supply channel defined therin, the air supply channel extending along a central line thereof to a mouth of the driving axle at the inside portion of the housing;

a spacer in operative engagement with the driving axle and the disc;

a semi-spherical hollow flexible rubber socket having an open bottom edge portion at one end and a closed round top portion, the bottom edge portion having an opening defined therein, the bottom edge portion being captured between the spacer and the large diameter disc so that an enclosed cavity is defined inside the rubber socket, the rubber socket being movable between an air-filled expanded position and an unfilled collapsed position;

an abrasive semi-spherical sleeve being arranged to enclose the rubber socket and to be locked to the rubber socket when the rubber socket is filled with air and expanded into the air-filled expanded position; and a rubber tube being sealingly arranged about the inside portion to cover the mouth of the air supply channel, the rubber tube preventing air in the cavity from leaking back out through the air supply channel.

2. The pneumatic sanding roll according to claim 1 wherein the large diameter disc has a cavity defined therein to matchingly receive the spacer.

3. The pneumatic sanding roll according to claim 1 wherein the driving axle has a threaded portion and a nut is screwed onto the threaded portion to tightly hold the spacer against the large diameter disc.

4. The pneumatic sanding roll according to claim 1 wherein a cloth sleeve has an open edge and a tape adhered along the open edge.

5. The pneumatic sanding roll according to claim 1 wherein the rubber socket has a top protrusion.

6. The pneumatic sanding roll according to claim 1 wherein the cloth sleeve has a central top opening defined therein to receive the top portion of the rubber socket.

7. The pneumatic sanding roll according to claim 1 wherein a cloth sleeve is made of a non-expandable material.

* * * * *